US006443386B1

(12) United States Patent
Bednarczyk et al.

(10) Patent No.: US 6,443,386 B1
(45) Date of Patent: Sep. 3, 2002

(54) SYSTEM AND METHODS FOR AUTOMATICALLY ADJUSTING TURNAROUND POSITION IN SPOOL WINDERS

(75) Inventors: David A. Bednarczyk, Wilmington; Tyrone Reid, Hampstead, both of NC (US); Mark S. Tota, Horseheads, NY (US); T. Stan Walton, Wilmington, NC (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/473,939

(22) Filed: Dec. 28, 1999

Related U.S. Application Data

(60) Provisional application No. 60/114,032, filed on Dec. 29, 1998.

(51) Int. Cl.[7] ..... B65H 54/32

(52) U.S. Cl. ..... 242/478.2; 242/477.1

(58) Field of Search ..... 242/478.2, 477.1, 242/476.7, 483.3, 920

(56) References Cited

U.S. PATENT DOCUMENTS 3,038,674 A 6/1962 Wahl ..... 242/478.2
4,050,641 A 9/1977 Henrich ..... 242/478.2
4,156,509 A 5/1979 Mander et al. ..... 242/478.2
4,920,738 A 5/1990 White ..... 57/62
6,027,062 A * 2/2000 Bacon et al. ..... 242/920 X
6,131,845 A * 10/2000 Burlingame et al. ..... 242/476.7

* cited by examiner

*Primary Examiner*—Michael R. Mansen
*Assistant Examiner*—Minh-Chau Pham
(74) *Attorney, Agent, or Firm*—Robert L. Carlson

(57) ABSTRACT

A system for winding optical fiber onto a spool includes a spindle assembly for receiving the spool and rotating it around its longitudinal axis. A fiber source for providing a continuous supply of fiber to the spool is positioned relative to the spindle assembly such that rotation of the spool by the spindle assembly causes fiber to be wound onto the spool around its longitudinal axis. A tension sensing device senses and provides feedback related to the amount of tension in the fiber. A traverse assembly causes the fiber to wind onto the spool back and forth between a front spool flange and a rear spool flange, the traverse assembly including a front turnaround position at the front spool flange and a rear turnaround position at the rear spool flange. A controller receives the fiber tension feedback and uses the feedback to determine what adjustment, if any, is to be made to the front and rear turnaround positions.

27 Claims, 10 Drawing Sheets

SYSTEM AND METHODS FOR AUTOMATICALLY ADJUSTING TURNAROUND POSITION IN SPOOL WINDERS

CROSS-REFERENCE TO RELATED APPLICATIONS

This application claims the benefit of priority under 35 U.S.C. §119(e) of U.S. Provisional Application Ser. No. 60/114,032 filed on Dec. 29, 1998.

BACKGROUND OF THE INVENTION

1. Field of the Invention

The present invention relates generally to improvements to systems and methods for winding optical fiber onto spool, and more particularly to advantageous aspects of a system and methods for controlling turnaround positions at spool flanges.

2. Description of the Prior Art

In typical prior art winding machines, optical fiber is wound onto the barrel of a rotating spool up and down its length between a pair of spool flanges. The control of the winding process has been a challenge for many years. One issue that has been particularly challenging is the control of the turnaround positions, i.e., the point at each flange at which the transverse motion of the spool relative to the fiber is reversed.

A turnaround should ideally occur at the point where the fiber has just reached a flange. Turnaround positions are therefore commonly preset based upon a standard size takeup spool, with flanges of known thickness. However, because of variability in spool manufacture, the turnaround position may not be precisely correct for a particular flange. If the turnaround occurs too late, an excess of fiber may accumulate at the flange, resulting in what is called a "dogbone" condition. If the turnaround occurs too early, a gap may result at the flange. Another condition that may arise if the turnaround occurs too early is a "cascade" condition, in which the fiber is wound onto the spool in a non-uniform, serpentine curl. Any of these conditions will cause fiber to be wound unevenly at the flange. These error conditions are particularly significant in the manufacture of optical fiber, where an improper winding of the spool may have a detrimental effect on fiber performance.

Prior art systems typically provide only for manual intervention by an operator to control the turnaround points of the spool based upon an observed dogbone or flange gap condition. However, this approach is disadvantageous for a number of reasons. First, it requires a number of turnarounds for a dogbone or flange gap condition to become apparent to an operator. Second, adjustment of the turnaround position is imprecise and requires several additional turnarounds to confirm that the error condition has been in fact corrected. These factors greatly decrease the efficiency of the winding process.

There is thus a need for an automatic system for adjusting the turnaround position at spool flanges in a winding machine.

SUMMARY OF THE INVENTION

A presently preferred embodiment of the invention provides a system for winding optical fiber onto a spool. The system comprises a spindle assembly for receiving the spool and rotating it around its longitudinal axis. A fiber source for providing a continuous supply of fiber to the spool is positioned relative to the spindle assembly such that rotation of the spool by the spindle assembly causes fiber to be wound onto the spool around its longitudinal axis. A tension sensing device senses and provides feedback related to the amount of tension in the fiber being wound onto the spool. A traverse means causes the fiber to wind onto the spool back and forth between a front spool flange and a rear spool flange, the traverse means including a front turnaround position at the front spool flange and a rear turnaround position at the rear spool flange. A controller receives the fiber tension feedback and uses the feedback to determine what adjustment, if any, is to be made to the front and rear turnaround positions.

Additional features and advantages of the present invention will become apparent by reference to the following detailed description and accompanying drawings.

DETAILED DESCRIPTION

A preferred embodiment of the invention provides a system and methods for winding fiber onto a spool that automatically corrects for both spool variability and differences in traverse turnaround positions. The invention checks the "flatnes" of the fiber's wrap at both turnaround positions as each relates to the spool's midpoint diameter and dancer setpoint position. A system control loop incorporates the change in the spool's diameter into a feedback dancer control loop, which in turn provides the system controller with the information that is needed to correct each of the spool's turnaround positions, by either moving it towards or away from the respective flange on each subsequent pass.

Figure 1:
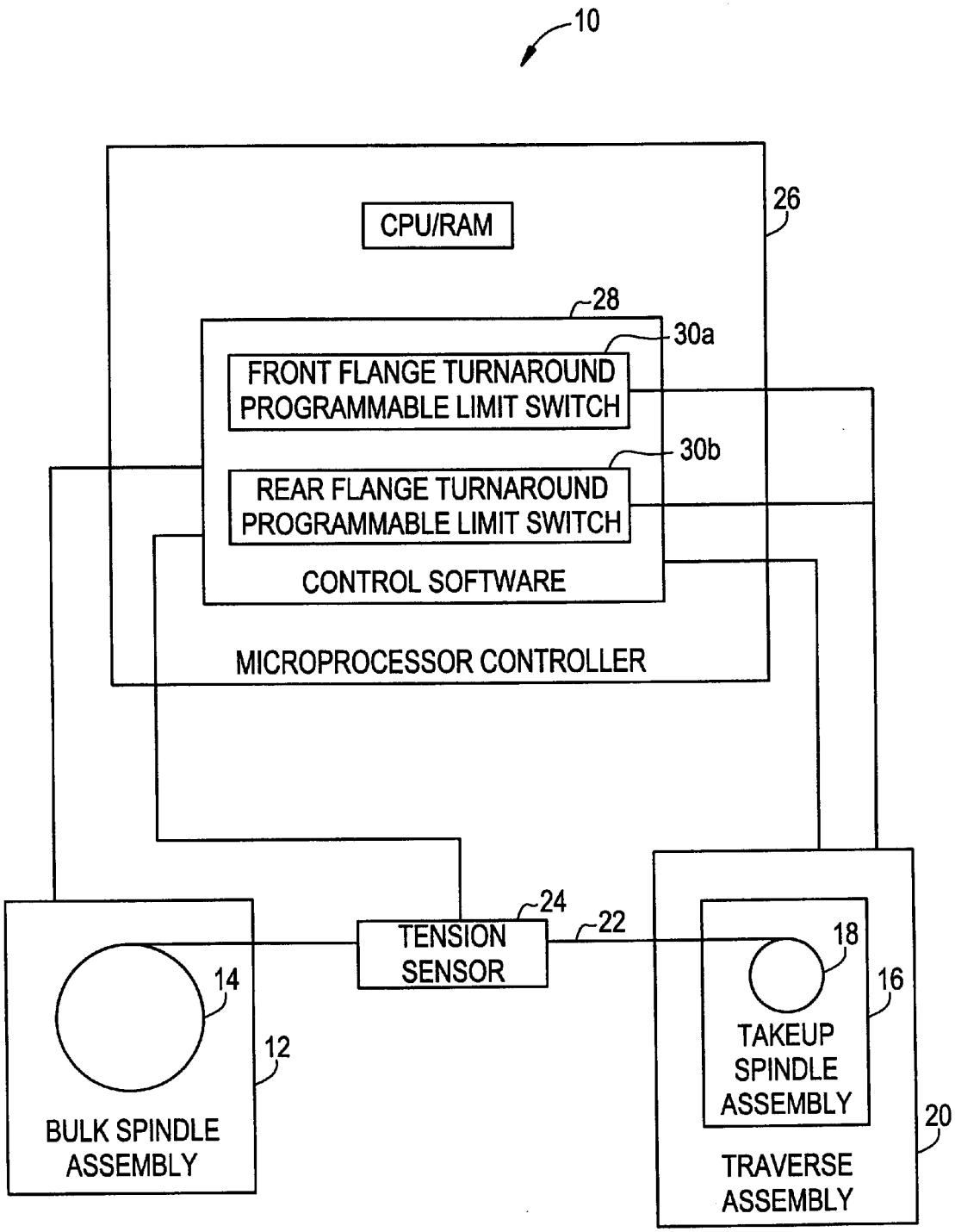
FIG. 1 shows a diagram of a presently preferred embodiment of a system according to the invention.

FIG. 1 shows a block diagram of the major components of a presently preferred embodiment of a system 10 according to the invention. The system 10 includes a bulk spindle assembly 12 on which a manufacturing bulk spool 14 is mounted, and a takeup spindle assembly 16 on which a takeup spool 18 is mounted. The spindle assembly 16 is itself mounted to a traverse assembly 20, which moves the assembly 16, and thus the takeup spool 18, back and forth in a transverse direction as it is being rotated. Optical fiber 22 is threaded from the bulk spool to the takeup spool through a tension sensor 24, which measures and provides as an output the tension of the fiber 22 being wound onto the takeup spool 18. The bulk spindle assembly 12, takeup spindle assembly 16 and traverse assembly 20 are controlled by a microprocessor controller 26, which includes control software 28. The control software comprises a pair of programmable limit switches 30*a,* 30*b,* the functioning of which is described in further detail below. In the presently preferred embodiment, the microprocessor controller comprises a VME Intel 80486-based PC control system, programmed in the C computer language.

Figure 2:
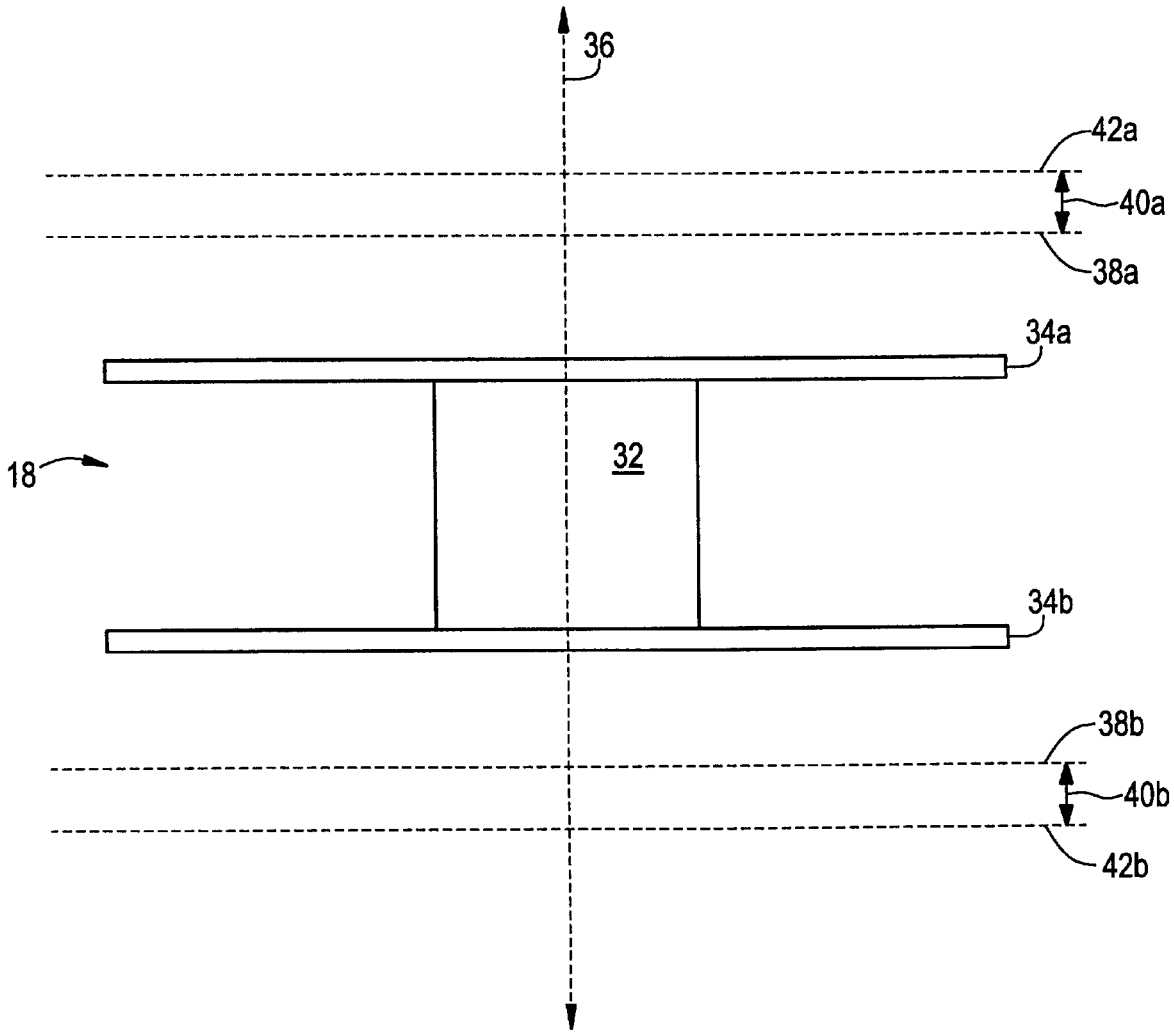
FIG. 2 shows a side view of a takeup spool for use in a presently preferred embodiment of the invention.

FIG. 2 shows a side view of a takeup spool 18 for use in the presently preferred embodiment of the invention. The takeup spool includes a cylindrical barrel 32 around which the fiber 22 is wound. The takeup spool 18 farther includes a pair of flanges, a front flange 34*a* that faces out towards the machine operator when the spool is mounted into the takeup spindle assembly 16, and a rear flange 34*b* that faces in towards the screening machine, away from the machine operator. When the takeup spool 18 is mounted in the spindle assembly 16, the spindle assembly 16 rotates the spool around its longitudinal axis 36. The traverse assembly 20 causes the rotating spool to move back and forth along its longitudinal axis 36.

Guided by the microprocessor controller 26, the takeup spool spindle assembly 16 and the takeup spool traverse assembly 20 combine to cause the optical fiber 22 to be wound onto the takeup spool 18 up and down the length of the barrel 32 in a series of layers between the front and back flanges 34*a,* 34 *b.* The turnaround positions, i.e., the point at each takeup spool flange at which the traverse assembly causes the rotating takeup spool to reverse direction along its longitudinal axis, are determined by a pair of programmable limit switches (PLS's) 30*a,* 30*b* in the control software 28, one for the front flange turnaround, and the second for the rear flange turnaround. Each programmable limit switch is detected and initiated as the traverse approaches the respective spool flange, at which point the controller starts a turnaround sequence, or routine, providing a digital cam profile that performs the following three functions: (1) detecting the current traverse position; (2) commencing a deceleration of the traverse to a predetermined stopping position; and (3) commencing an acceleration of the traverse to a predetermined rate in the opposite direction.

In the presently preferred embodiment of the invention, the turnaround positions at each flange are calculated by the controller 26 by adding together a preset turnaround position and an adjustable flange offset, which can be positive, zero, or negative:

TURNAROUND_POSITION=SET_TURNAROUND_POSITION+FLANGE OFFSET

These quantities are illustrated in FIG. 2, where for front flange 34*a,* the set turnaround position is represented by broken line 38*a,* the flange offset is represented by distance 40*a,* and the calculated turnaround position is represented by broken line 42*a.* Similarly, for rear flange 34*b,* the set turnaround position is represented by broken line 38*b,* the flange offset is represented by distance 40*b,* and the calculated turnaround position is represented by broken line 42*b.*

The preset turnaround positions 38*a,* 38*b* are based upon the known width of the winding surface on the takeup spool barrel 32. Ideally, the preset turnaround positions will be sufficient to cause the optical fiber to be properly wound between the flanges 34*a,* 34*b* without the need for the addition of a flange offset 40*a,* 40*b.* Unfortunately, because of variability in the manufacture of takeup spools, the predetermined turnaround points for the traverse assembly may not be sufficient to allow the fiber to be properly wound onto the takeup spool.

Figure 3:
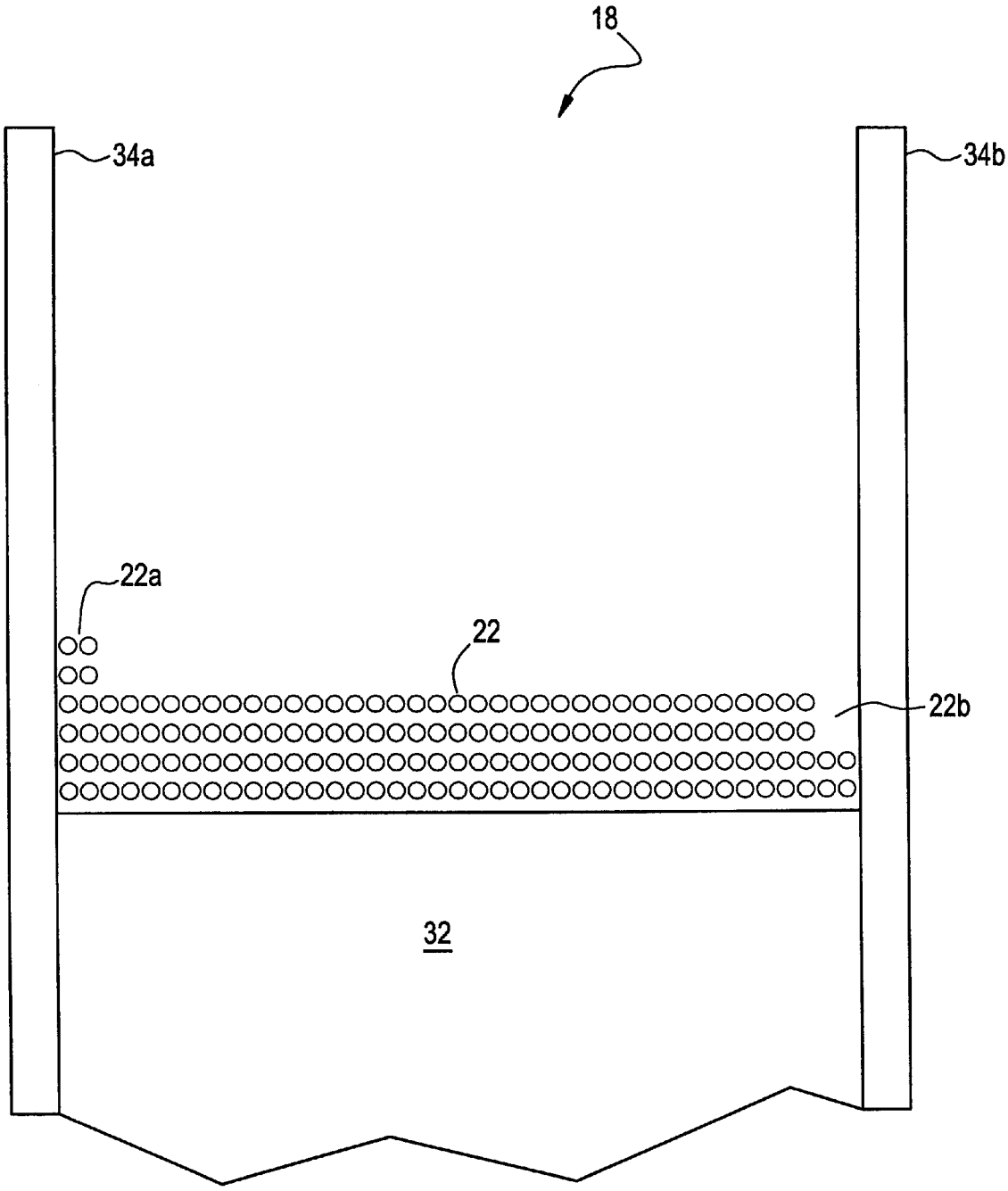
FIG. 3 shows a partial cross section of a partially wound takeup spool.

Specifically, the turnaround may occur too late at a flange, causing an excess of fiber to accumulate at that flange, or too early, causing a gap to form at that flange. The first condition is known as a "dogbone," and the second, as a "flange gap." These undesirable conditions are illustrated in FIG. 3, which shows a partial cross section of a takeup spool, turned on its side. FIG. 3 shows two layers of fiber that have been properly wound and two layers during the winding of which the turnaround has occurred at an improper point. The left side of the drawing illustrates a dogbone condition 22*a* and the right side, a flange gap 22*b.* In addition to these two types of errors, there is also an error condition known as a "cascade," which is a non-uniform serpentine curl of the fiber. Like a flange gap, a cascade condition can occur when the turnaround takes place too soon at a flange. As described further below, the present invention provides an advantageous method for automatically adjusting the flange turnaround to minimize the occurrence of dogbones, flange gaps, and cascades based upon feedback provided by the measured tension of the optical fiber at each of the two turnarounds.

Figure 4:
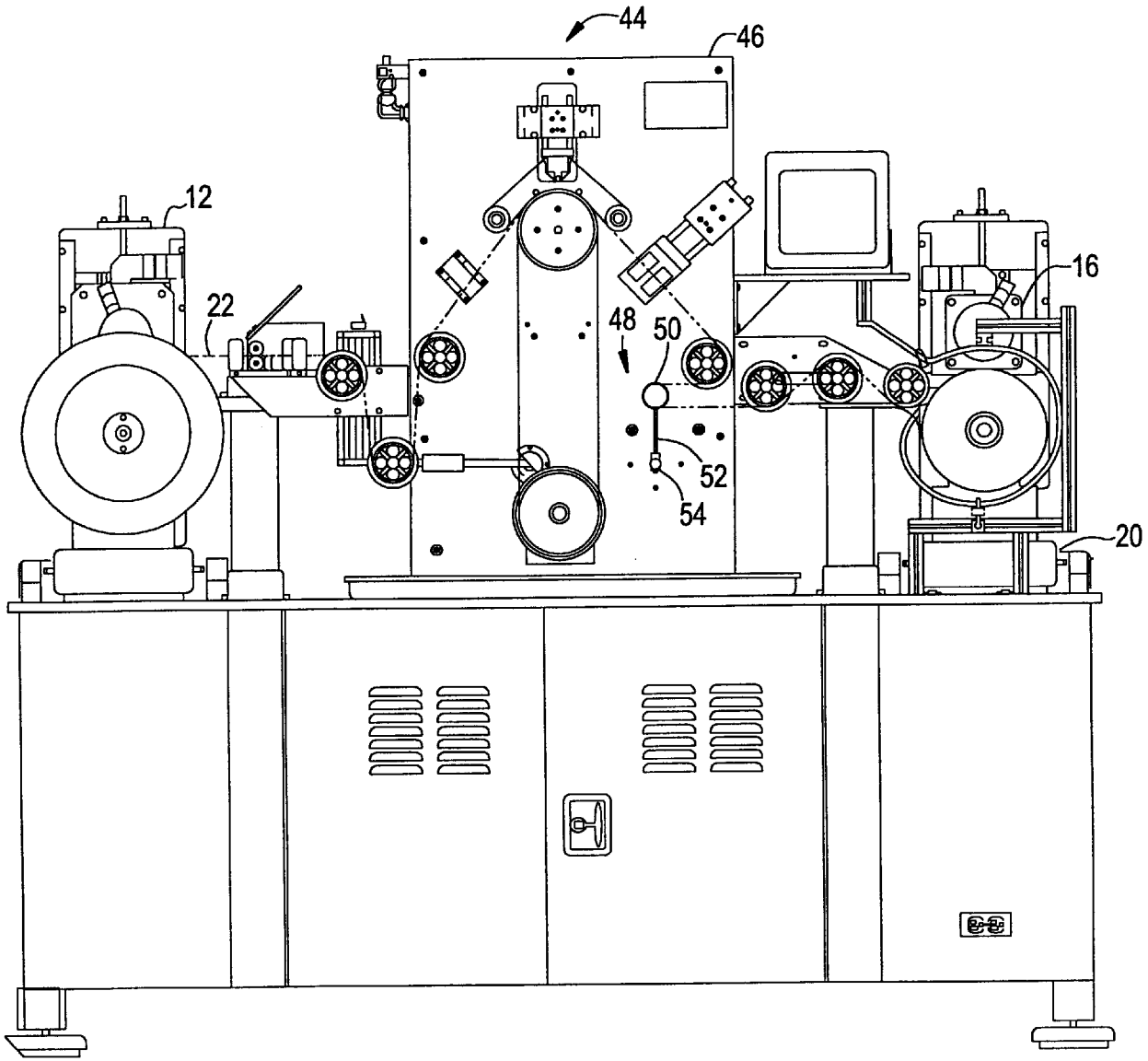
FIG. 4 shows a front view of a screening machine for use in a presently preferred embodiment of the invention.

FIG. 4 shows a diagram of a screening machine 44 that is used in a presently preferred embodiment of the invention. The three major components of the machine are the bulk spool spindle assembly 12, the takeup spool spindle assembly 16 and traverse assembly 20, and the screening assembly 46 between the two spools. As shown in FIG. 4, the optical fiber 22 is threaded through a series of pulleys, which create a path for the fiber through various stages of the screening process. Of particular interest to the present invention is a dancer assembly 48, which provides the function of the tension sensor 24 shown in FIG. 1, and is used to measure the tension of the optical fiber 22 as it is wound onto the takeup spool 16.

The dancer assembly comprises a pulley 50 around which the fiber 22 is threaded, a dancer arm 52, and a pivot armature 54. A brush DC motor (not shown), includes armature 54, which extends out of both ends of the DC motor. One end of armature 54 connects to dancer arm 52, and applies a constant torque to the dancer arm 52 in a counterclockwise direction. The tension in the optical fiber 22 threaded through the pulley applies torque to the dancer arm in a clockwise direction. The torque applied by the DC motor balances the torque applied by the tension of the optical fiber. During the initialization of the screening machine 44, there is established a setpoint position of the dancer arm 52, which is the dancer arm position representing an optimal amount of tension in the optical fiber being wound onto the spool. In the presently preferred embodiment, the setpoint position is calibrated to be 90 degrees from horizontal. However, it would be possible to use any number of positions for the dancer arm 52 as the setpoint position.

The position of the dancer arm 52 is detected by a suitable position sensing device. In the presently preferred embodiment of the invention, the position of the dancer arm 52 is sensed using a rotary variable differential transformer (RVDT). The RVDT is connected to the other end of armature 54, which extends from the DC motor. Thus, one end of armature 54 connects to dancer arm 52, while the other end of armature 54 connects to the RVDT. When dancer arm 52 moves about armature 54, armature 54 is caused to rotate. This rotation is sensed by the RVDT, causing the RVDT to generate a voltage signal that bears a linear relationship to the amount of shaft rotation, and thus the amount of movement of dancer arm 52. Thus, the microprocessor controller 26 determines the position of the dancer arm 52 by monitoring the RVDT voltage signal. The position of the dancer arm is, of course, directly related to the amount of tension in the fiber being wound onto the spool.

Each dancer arm position corresponds to a different level of tension in the optical fiber 22. For the system shown in FIG. 4, when the tension of the fiber 22 falls below the optimal level, the dancer arm 52 will swing away from the dancer setpoint in a counterclockwise direction to a new position to the left of the setpoint, the new position indicating the lower tension level. When the tension of the fiber 22 rises above the optimal value, the dancer arm 52 will swing away from the dancer setpoint in a clockwise direction to a new position to the right of the setpoint, the new position indicating the higher tension level. The tension of the fiber 22 is a function of a number of variables, including the takeup spool diameter and the rotational speed of the spool.

Figure 5B:
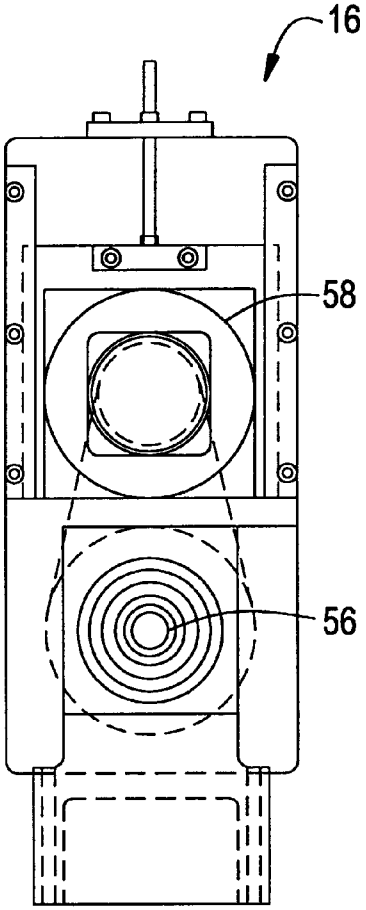
FIGS. 5A and 5B show, respectively, side and front views of a takeup spindle assembly suitable for use in the screening machine shown in FIG. 4.
Figure 5A:
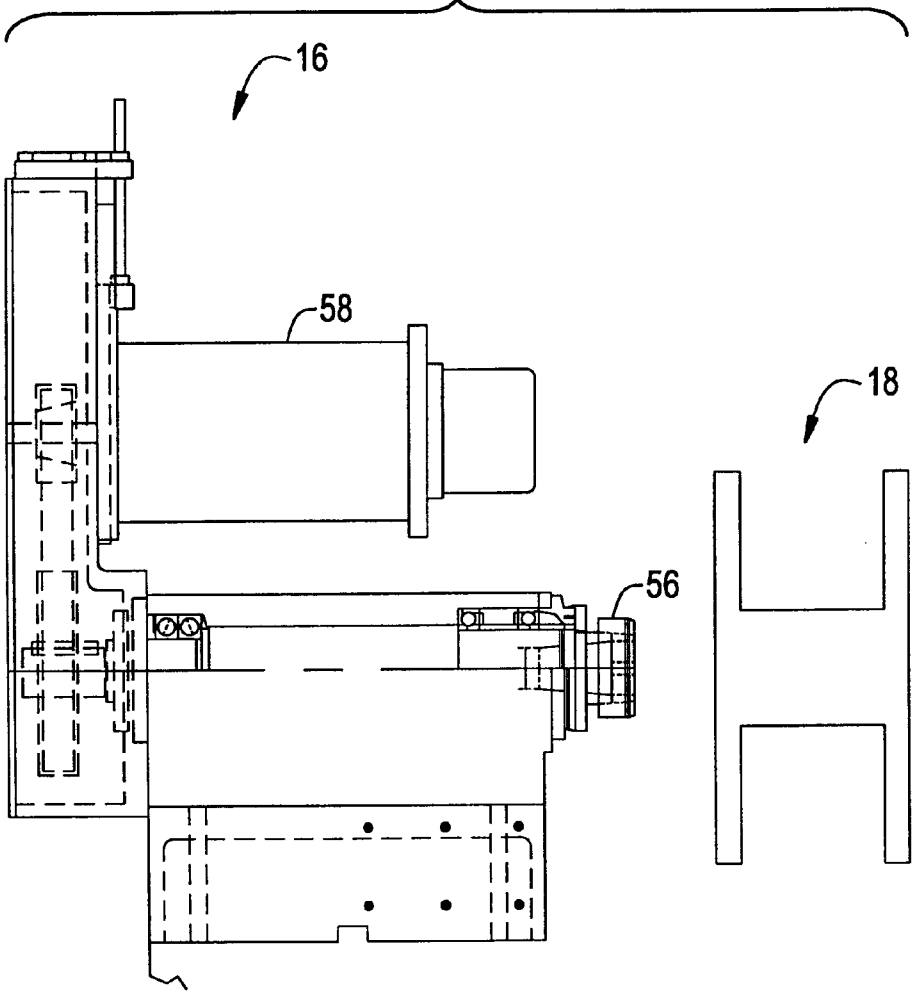

FIGS. 5A and 5B show, respectively, side and front views of a spindle assembly 16 suitable for use in the presently preferred embodiment of the invention. The spindle assembly 16 includes a spindle 56 upon which the takeup spool 18 is mounted, and a servo motor 58 for rotating the spool 18 around its longitudinal axis.

Figure 6C:
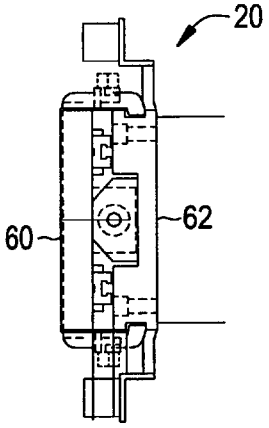
FIGS. 6A, 6B, and 6C show, respectively, top, side, and front views of a traverse assembly suitable for use in the screening machine shown in FIG. 4.
Figure 6A:
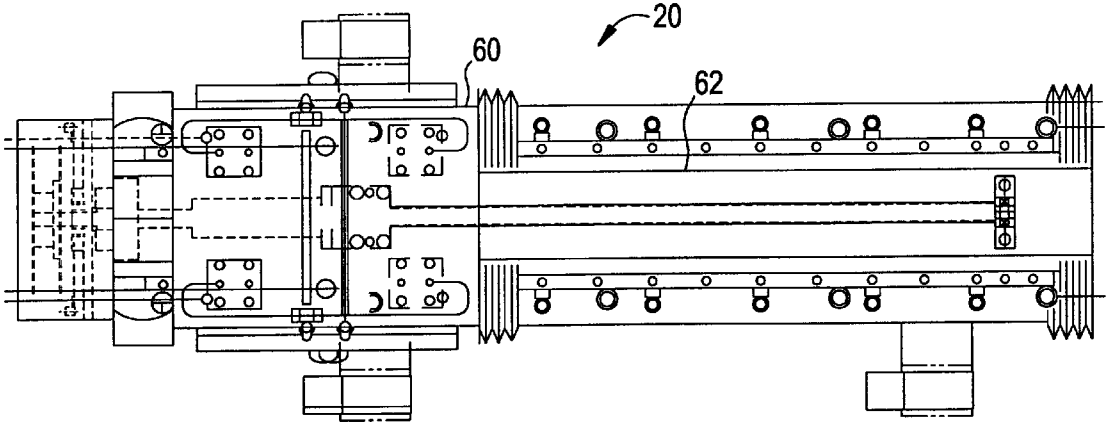
Figure 6B:
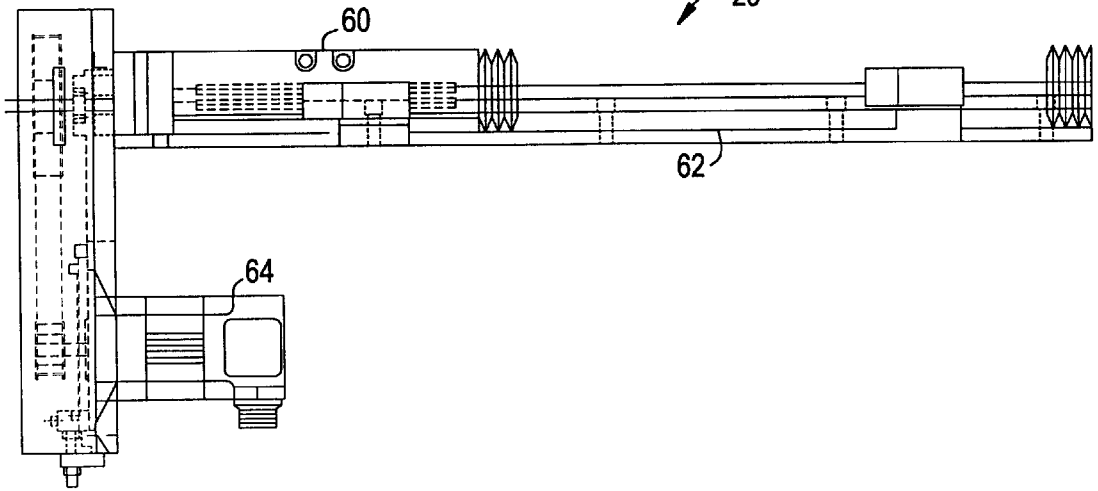
Figure 7B:
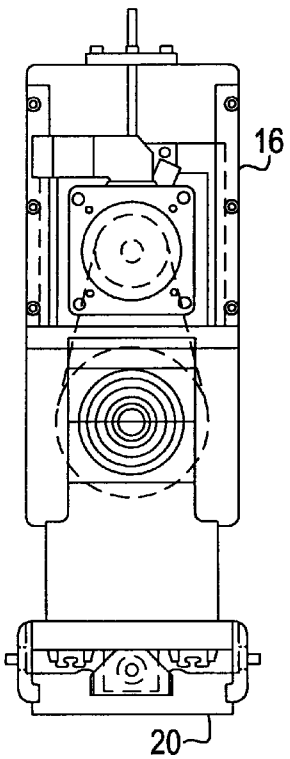
FIGS. 7A and 7B show, respectively, side and front views of the takeup spindle assembly shown in FIGS. 5A and 5B mounted to the traverse assembly shown in FIGS. 6A, 6B, and 6C.
Figure 7A:
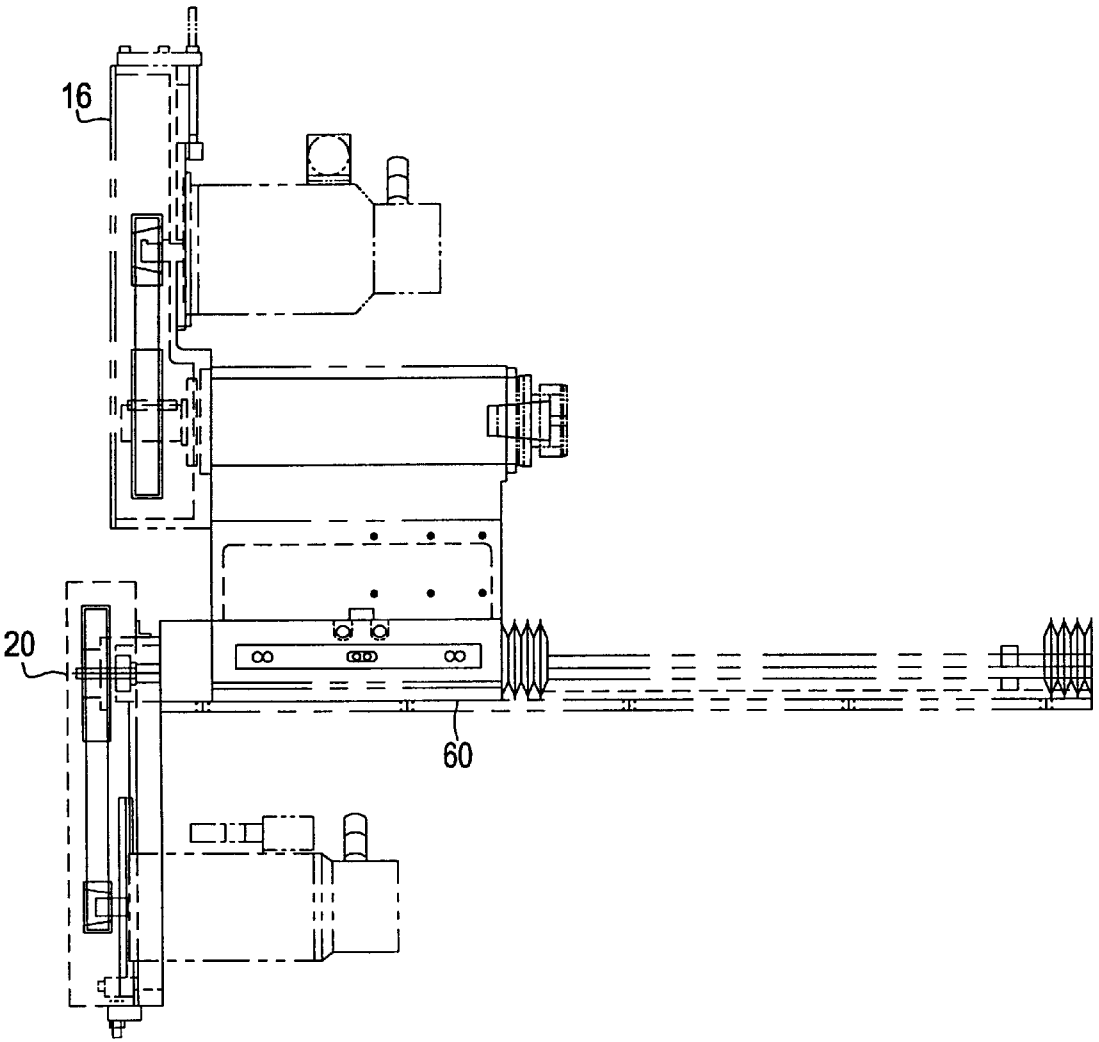

FIGS. 6A, 6B, and 6C show, respectively, top, side, and front views of a traverse assembly 20 that is suitable for use in conjunction with the spindle assembly shown in FIGS. 5A and 5B to move the takeup spool 18 back and forth along its longitudinal axis as the spindle assembly 16 rotates the spool 18. The traverse assembly 20 includes a carriage 60 upon which the spindle assembly 16 is mounted. The carriage 60 is mounted onto a track rail 62 that defines the linear path along which the spindle assembly 16 travels. The traverse assembly 20 includes a reversible motor 64 that moves the spindle assembly 16 back and forth on the traverse assembly track 62. FIGS. 7A and 7B show, respectively, side and front views of the spindle assembly 16 mounted to the carriage 60 of the traverse assembly 20.

Figure 8:
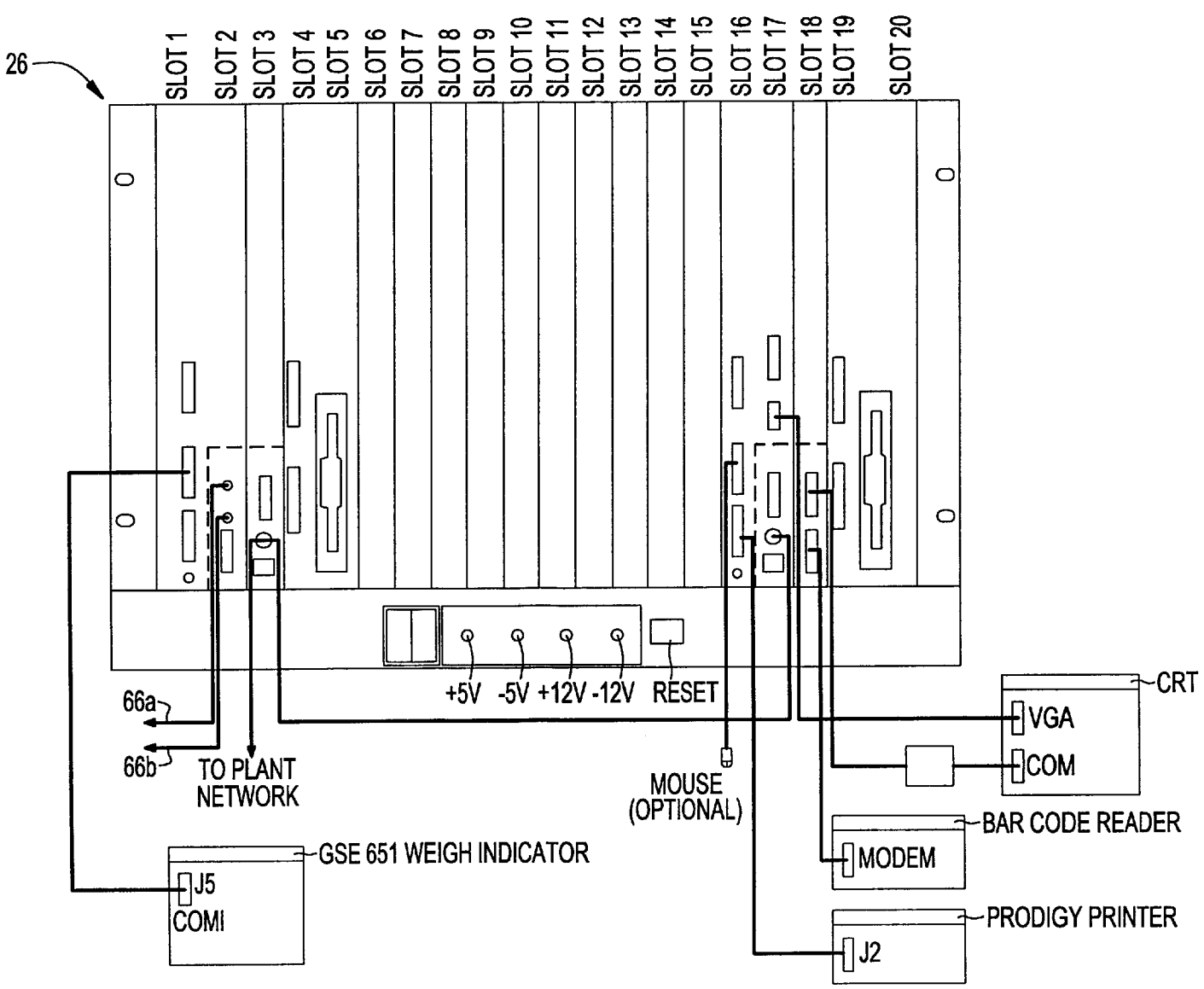
FIG. 8 shows a rear view of a microprocessor controller for use in a presently preferred embodiment of the invention.

FIG. 8 shows the rear panel of a controller 26 for use with the present invention. Two leads 66*a,* 66*b* are provided for connecting the other components of the system to the controller 26. The controller 26 can precisely control the distance traveled by the spindle assembly 16 along the track rail 62 of the traverse assembly 20 by counting the traverse motor steps or turns. Further, the controller 26 can reverse the direction of travel of the spindle assembly 16 along the traverse assembly track rail 62 by reversing the direction of motor rotation.

As shown in FIG. 1, in the presently preferred embodiment of the invention, the controller is provided with a pair of programmable limit switches 30*a,* 30*b,* one for each turnaround position. As described above, each switch is detected and initiated as the traverse approaches the respective spool flange. As the PLS fires, it starts a turnaround sequence, or routine, that runs to do three things: (1) detect the current traverse position; (2) begin the deceleration of the traverse to a predetermined stopping position; and (3) begin an acceleration of the traverse to a predetermined rate in the opposite direction.

The present system provides a system and method which advantageously uses the tension information from the tension sensor 24, i.e., the position of the dancer arm 52 in dancer assembly 48, to detect and correct for error conditions in the winding process. The tension of the fiber is determined by a number of factors, including the speed of rotation of the takeup spool and the diameter of the winding surface spool. Prior art systems have used feedback from the dancer assembly 48 to control the rotational speed of the spindle assembly 16 in order to maintain the tension of the optical fiber 22 at an optimal level, represented by the dancer setpoint. However, dancer feedback has not heretofore been used to make adjustments to the flange turnaround positions.

When a dogbone or a flange gap condition occurs, there is a measurable spike or dip in fiber tension at the turnaround positions. For example, in a dogbone condition, the diameter of the winding surface increases at the flange turnaround position, producing a concomitant increase in the tension in the optical fiber. In a flange gap condition, the diameter of the winding surface decreases at the flange turnaround position, producing a decrease in the tension in the optical fiber. These changes in fiber tension are reflected in a deviation of the dancer arm position from the dancer setpoint at the turnaround positions. The presently preferred embodiment of the invention uses this deviation as the basis for making an adjustment to the flange turnaround positions.

Figure 9:
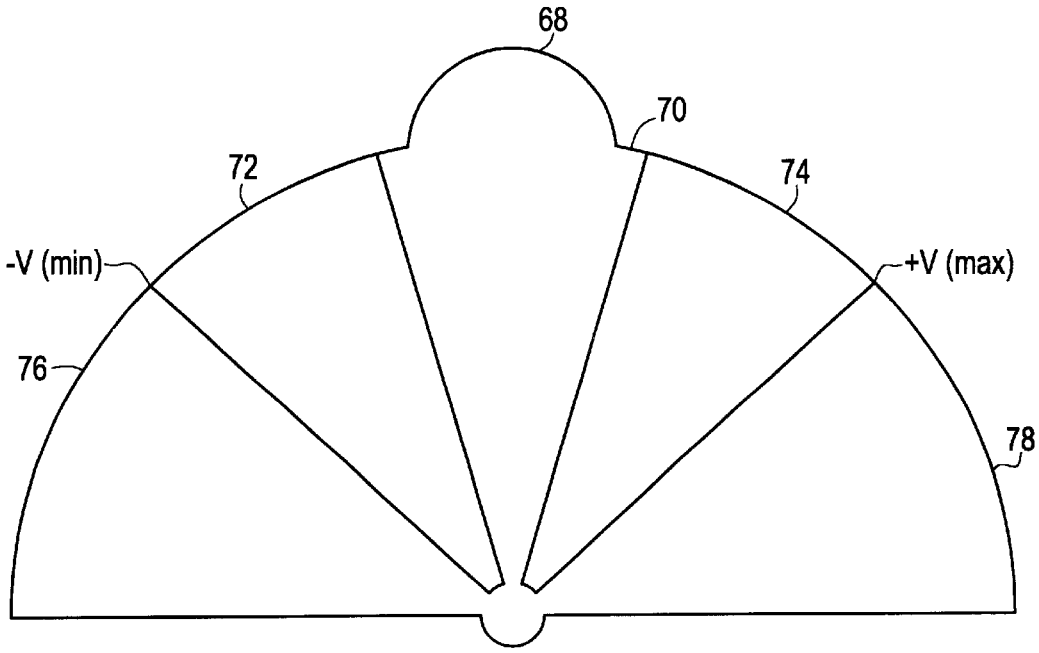
FIG. 9 shows a diagram of the range of possible captured dancer arm positions in a presently preferred embodiment of the invention.

In the presently preferred embodiment of the invention, the dancer arm position is captured at the flange turnarounds. Specifically, the dancer arm position is captured at the start of the third step in the cam profile routine described above. At that point in the routine, the traverse has reached its predetermined stopping position prior to acceleration in the opposite direction. The range of captured dancer arm positions employed in the illustrated embodiment is shown in FIG. 9. There is a predetermined dancer setpoint 68, i.e., a dancer arm position reflecting optimal fiber tension. Immediately surrounding the setpoint is a "deadband" 70, which is the range of acceptable captured dancer arm positions adjacent the setpoint, i.e., the error threshold of the system. So long as the captured dancer arm position is within the deadband 70, no error is detected. Immediately to the left of the deadband is a region 72 indicating a drop in fiber tension associated with a flange gap. Similarly, immediately to the right of the deadband 70, is region 74 indicating an increase in fiber tension associated with a dogbone condition. The regions 76, 78 outside of −V(min) or +V(max) indicate that an alarm condition has occurred, requiring system intervention.

Figure 10:
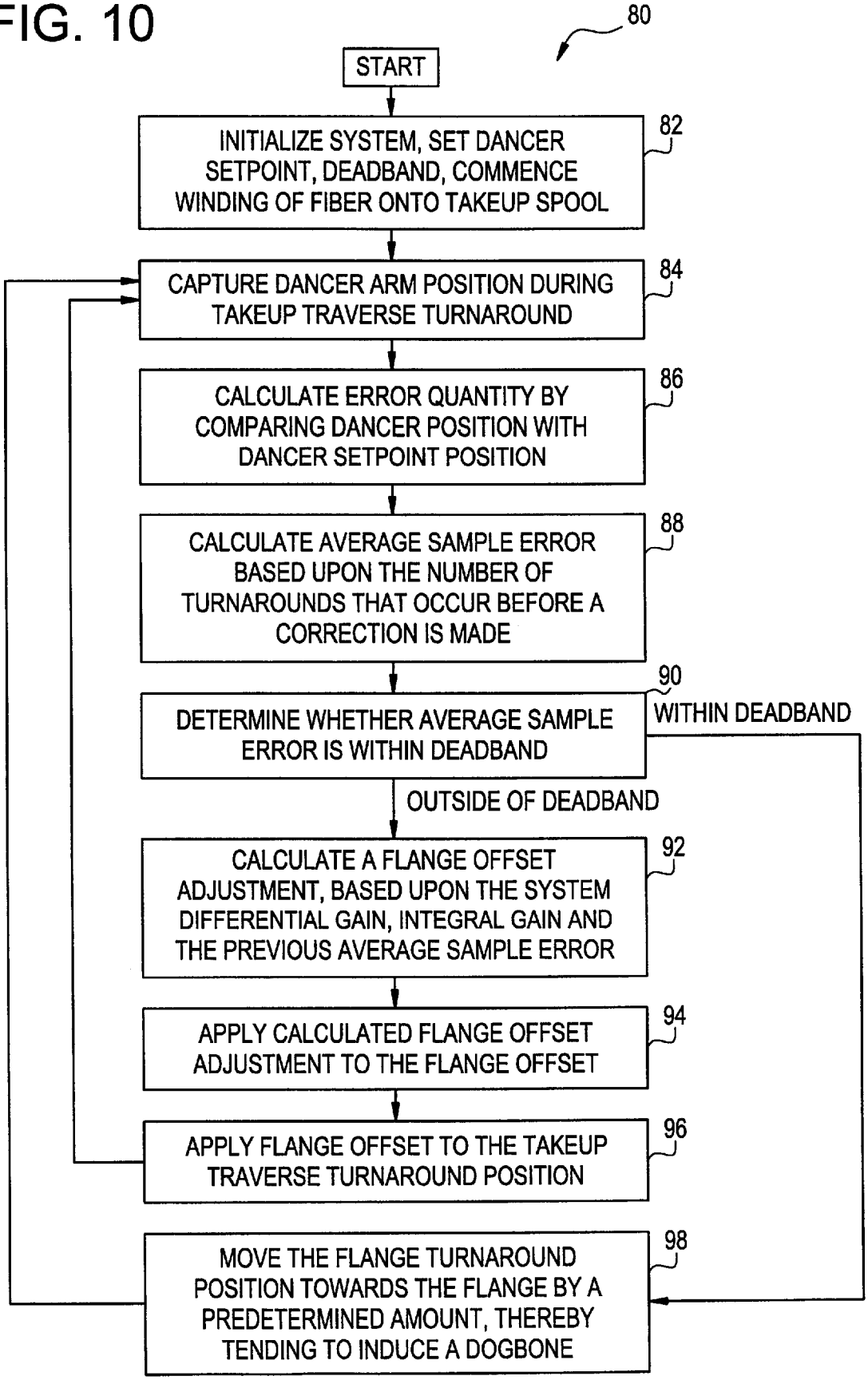
FIG. 10 shows a flowchart of a preferred embodiment of a method according to the invention.

FIG. 10 is a flowchart of a presently preferred embodiment of a method for automatically adjusting flange turnaround positions 80 according to the present invention. In a first step 82, the system is initialized. As part of this initialization, the dancer setpoint and deadband are set. Once the initialization has been completed, the screening machine commences the winding of the optical fiber onto the takeup spool.

In a second step 84, the controller 26 captures the dancer arm position TURNAROUND_DANCER_POSITION during each takeup spool traverse turnaround. As explained above, this is the point at each flange at which the transverse motion of the rotating spool along its longitudinal axis is reversed. As further explained above, one way of implementing this step is to use controller software that comprises a pair of programmable limit switches that fire at designated turnaround points to initiate the turnaround at each flange. In this implementation, the dancer arm position is captured when the traverse stops immediately prior (e.g., approximately 2 msec) to acceleration in the reverse direction. In practice, the maximum lag in the snapshot of the dancer position is 8 msec. This is relatively insignificant compared with the 50–65 msec required for the turnaround.

In step 86, the controller calculates an error quantity by comparing the snapshot of the dancer position with the dancer setpoint. The calculation can be expressed as follows:

ERROR=TURNAROUND_DANCER_POSITION−SETPOINT_DANCER_POSITION

In step 88, the AVERAGE_SAMPLE_ERROR is then calculated. This is based upon the number of passes/turnarounds that occur before a correction is made. The controller can adjust this number, as desired. This calculation is as follows:

$$\text{AVERAGE_SAMPLE_ERROR} = \frac{\sum_{n=0}^{n=N} ERROR_n}{N}$$

where N=number of passes before correction.

In step 90, the controller then determines whether the AVERAGE_SAMPLE_ERROR is within the set deadband. The deadband is adjustable by the operator, as desired, using a keyboard, mouse, or other suitable input device connected to the microprocessor controller.

In step 92, if the AVERAGE_SAMPLE_ERROR is not within the set deadband, a correction is made to the flange offset. Calculations are made to the adjustment of the flange offset based upon the gain of the system. The system gain includes two components, a differential gain D_GAIN, based upon the difference between the current average sample error and the previous average sample error, and an integral gain I_GAIN, based upon the magnitude of the current average sample error. The differential and integral gains are machine-specific quantities that are measured using known techniques. These gains are used to calculate the adjustment to be made to the flange turnaround position OFFSET_ADJUST using the following formula:

OFFSET_ADJUST=[D_GAIN(AVERAGE_SAMPLE_ERROR−PREVIOUS_AVERAGE_SAMPLE_ERROR)]+[I_GAIN-(AVERAGE_SAMPLE_ERROR)]

The use of both D_GAIN and I_GAIN in this manner is advantageous because it is more sensitive and accurate than an approach in which a fixed offset adjustment is used. In the present embodiment, the system makes large adjustment for large errors, and small adjustments for small errors. Further, the loop algorithm used to calculate the flange adjustments is tunable, as desired.

A positive or negative AVERAGE_SAMPLE_ERROR indicates a dogbone or flange gap, respectively. In step 94, depending upon which flange, front or rear, is currently being sampled, the OFFSET_ADJUST will be applied to the FLANGE_OFFSET as follows:

Front flange:

FLANGE_OFFSET=FLANGE_OFFSET+FLANGE_ADJUST

Rear flange:

FLANGE_OFFSET=FLANGE_OFFSET−OFFSET_ADJUST

Finally, in step 96 the flange offset is applied to the takeup traverse turnaround position. This relocates the turnaround programmable limit switch (PLS) as follows:

TURNAROUND_POSITION SET=TURNAROUND_POSITION+FLANGE OFFSET

The controller then returns to step 84 to capture the dancer arm position at the next turnaround.

The detected presence of the dancer position within the deadband indicates that no error has occurred. Thus, theoretically, no correction is required to the flange turnaround position. However, it has been found, through experimentation, that even where the detected dancer position is within the deadband, it is nonetheless desirable in a presently preferred embodiment of the invention to make an adjustment to the flange position to induce a dogbone condition.

The reason that it is desirable to induce a dogbone is that a dogbone is much easier for the system to detect than a flange gap. A dogbone can be detected almost immediately, as there is an immediate increase in the diameter of the winding surface. In a flange gap situation, however, the fiber may continue to wind for several layers before the fiber "falls into" the gap, causing the drop in fiber tension.

In step 98, in order to prevent a flange gap from developing, a small, predetermined adjustment can be intentionally made in the flange turnaround position towards the flange before returning to step 84, even though the dancer position has been determined to be within the deadband. In this manner, the fiber being wound onto the spool will "creep"towards the flange at each pass until the system detects a dogbone condition. When the dogbone condition is detected, the system will make a normal adjustment to the flange turnaround position, as described above, drawing it back into the deadband. Once the turnaround position is back within the deadband, the creeping process can be made to start all over again.

It has been determined through experimentation that this flange adjustment is advantageously a fraction of the diameter of the fiber, such that it will take several passes for a dogbone to be induced. In a presently preferred embodiment, the optical fiber diameter is 250 microns, and the flange adjustment is approximately one-eighth of that diameter.

Further, in this embodiment, since a correction is made at each turnaround, the AVERAGE_SAMPLE_ERROR is calculated at each turnaround. In other words, N will be 1.

After the adjustment is made to the turnaround position, the controller returns to step 84 to capture the dancer arm position at the next turnaround.

Figure 11:
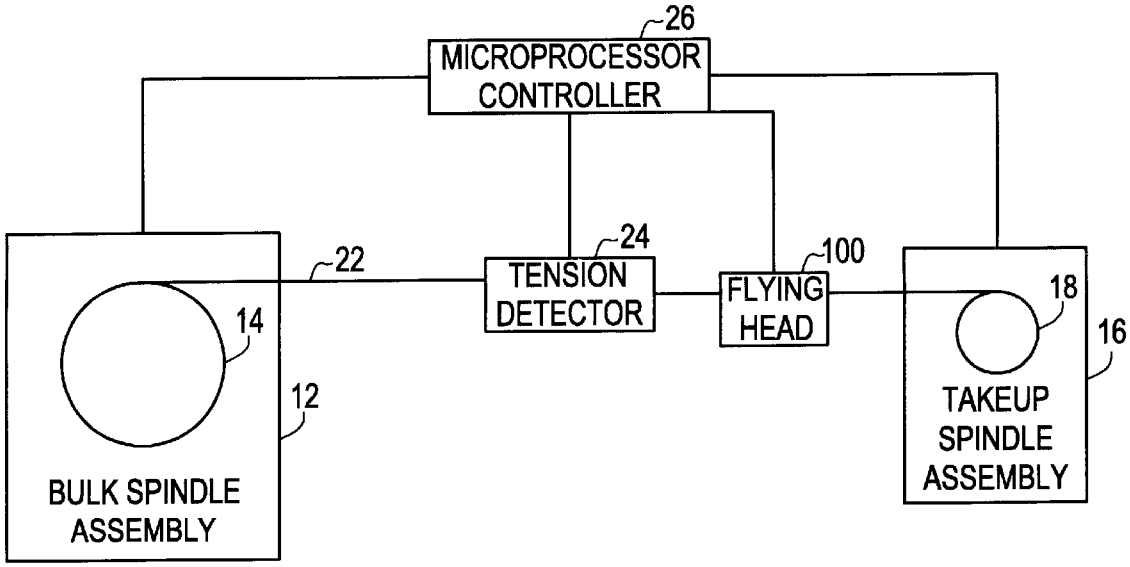
FIG. 11 shows an alternative embodiment of a system according to the present invention.

FIG. 11 shows an alternative embodiment of the invention, in which the fiber 22 is moved relative to the takeup spool 18 in the transverse direction by means of a flying head assembly 100. This embodiment of the invention functions in a substantially similar manner as the above embodiment. However, instead of moving the rotating spool back and forth on a traverse assembly, the system instead controls the back and forth movement of flying head 100. This is the type of arrangement found in, for example, a drawing machine used in the manufacture of optical fiber. In this second embodiment, the system again uses information from tension sensor 24 to monitor the tension in the optical fiber line, and uses that information to make adjustments to the turnaround positions for the flying head at either flange. Thus, it will be seen that the invention is equally applicable to this alternative embodiment.

Finally, it should be noted that although the present invention is particularly suitable for use with optical fiber, it can be used with other systems in which a fiber, wire, thread, or filament is wound onto a spool.

While the foregoing description includes details which will enable those skilled in the art to practice the invention, it should be recognized that the description is illustrative in nature and that many modifications and variations thereof will be apparent to those skilled in the art having the benefit of these teachings. For example, arrangements other than the above disclosed dancer assembly may be used to perform the function of tension sensor 24. It is accordingly intended that the invention herein be defined solely by the claims appended hereto and that the claims be interpreted as broadly as permitted by the prior art.

We claim:

1. A system for winding fiber onto a spool, the system comprising:

a spindle assembly for receiving the spool and rotating it around its longitudinal axis;

a fiber source for providing a continuous supply of fiber to the spool, the fiber source being positioned relative to the spindle assembly such that rotation of the spool by the spindle assembly causes fiber to be wound onto the spool around its longitudinal axis, a tension sensing device for sensing and providing feedback related to the amount of tension in the fiber, wherein the tension sensing device comprises a dancer assembly, said dancer assembly having a dancer arm against which the fiber is urged such that the position of the dancer arm is a function of the tension of the fiber as it is being wound onto the spool, the fiber source comprising a position sensor for detecting and providing as the feedback the position of the dancer arm;

traverse means for causing the fiber to wind onto the spool back and forth between a front spool flange and a rear spool flange, the traverse means including a front turnaround position at the front spool flange and a rear turnaround position at the rear spool flange;

a controller for receiving the fiber tension feedback and using said feedback to determine what adjustment, if any, is to be made to the front and rear turnaround positions, wherein the controller captures the dancer arm position during a turnaround sequence at a flange and compares the captured turnaround position with a setpoint dancer position to determine what adjustment, if any, is to be made to the front and rear turnaround positions.

2. The system of claim 1, wherein in comparing the captured turnaround dancer position with the setpoint dancer position, the controller calculates an error quantity by subtracting the setpoint dancer position from the captured turnaround dancer position.

3. The system of claim 2, wherein the controller calculates an average sample error by averaging the error quantities calculated for each turnaround before making an adjustment to an adjustable flange offset that, together with a set turnaround position, determines the turnaround position at each flange.

4. The system of claim 3, wherein a positive average sample error indicates a dogbone condition in which an excess amount of fiber is accumulating at the flange, and a negative average sample error indicates a flange gap condition or cascade condition.

5. The system of claim 4, wherein the controller determines whether the average sample error falls within a set deadband.

6. The system of claim 5, wherein if the average sample error falls within the deadband, the controller adjusts the flange offset such that the turnaround position is moved a predetermined distance toward the flange, thereby tending to induce a dogbone condition.

7. The system of claim 6, wherein the predetermined distance is a fraction of the diameter of the fiber.

8. The system of claim 7, wherein the predetermined distance is one-eighth of the diameter of the fiber.

9. The system of claim 5, wherein if the average sample error is outside of the deadband, the controller calculates an adjustment to be made to the flange offset.

10. The system of claim 9, wherein the adjustment to be made to the flange offset is calculated based on measured system gain.

11. The system of claim 10, wherein the measured system gain comprises a differential gain component D_GAIN and an integral gain component $I__{GAIN}$.

12. The system of claim 11, wherein the adjustment to the flange offset OFFSET_ADJUST is calculated by the following formula:

OFFSET_ADJUST=[D_GAIN(AVERAGE_SAMPLE_ERROR-PREVIOUS_AVERAGE_SAMPLE_ERROR)]+[I_GAIN-(AVERAGE_SAMPLE_ERROR)].

13. The system of claim 12, wherein the calculated offset adjustment is applied to the front flange using the following formula:

FLANGE_OFFSET=FLANGE_OFFSET+OFFSET_ADJUST and wherein the calculated offset adjustment is applied to the rear flange using the following formula:

FLANGE_OFFSET=FLANGE_OFFSET−OFFSET_ADJUST.

14. The system of claim 13, wherein the turnaround position for a flange is relocated for the next turnaround using the following formula:

TURNAROUND_POSITION=SET TURNAROUND_POSITION+

15. A method for winding fiber onto a spool, comprising:

rotating the spool around its longitudinal axis;

providing a continuous supply of fiber to the spool such that rotation of the spool causes fiber to be wound onto the spool around its longitudinal axis;

sensing and providing feedback related to the amount of tension in the fiber;

causing the fiber, as it is wound onto the spool, to traverse between a front spool flange and a rear spool flange;

changing the direction of the fiber traverse at first and second turnaround positions adjacent, respectively, to the front and rear spool flanges;

using the fiber tension feedback to determine what adjustment, if any, is to be made to the front and rear turnaround positions, wherein the step of using the fiber tension feedback to determine what adjustment, if any, is to be made to the front and rear turnaround positions, comprises calculating an error quantity by subtracting a setpoint tension from the amount of tension in the fiber sensed at each turnaround position.

16. The method of claim 15, further comprising:

calculating an average sample error by averaging the error quantities calculated for each turnaround position before an adjustment is made to an adjustable flange offset that, together with a set turnaround position, determines the turnaround position at each flange.

17. The method of claim 16, further comprising:

determining whether the average sample error falls within a set deadband.

18. The method of claim 17, further comprising:

adjusting the flange offset such that the turnaround position is moved a predetermined distance toward the flange if the average sample error falls within the deadband, thereby tending to induce a dogbone condition in which there is an excess amount of fiber accumulating at the flange.

19. The method of claim 18, in which the predetermined distance is a fraction of the diameter of the fiber.

20. The method of claim 19, in which the predetermined distance is one-eighth of the diameter of the fiber.

21. The method of claim 17, further comprising:

calculating an adjustment to be made to the flange offset if the average sample error is outside of the deadband.

22. The method of claim 21, wherein the step of calculating an adjustment to be made to the flange offset comprises:

calculating the adjustment to be made to the flange offset based upon measured system gain.

23. The method of claim 22, wherein the step of calculating the adjustment to be made to the flange offset based upon measured system gain comprises:

calculating the adjustment to be made to the flange offset based upon measured system gain comprising a differential gain component D_GAIN and an integral gain component I_GAIN.

24. The method of claim 23, wherein the step of calculating the adjustment to be made to the flange offset further comprises:

calculating the adjustment to the flange offset OFFSET_ADJUST is calculated using the following formula:

OFFSET_ADJUST=[GAIN(AVERAGE_SAMPLE_ERROR−PREVIOUS_AVERAGE_SAMPLE_ERROR)]+[I_GAIN-(AVERAGE_SAMPLE_ERROR)].

25. The method of claim 24, further comprising:

applying the calculated offset adjustment is applied to the front flange using the following formula:

FLANGE_OFFSET=FLANGE_OFFSET+OFFSET_ADJUST and applying the calculated offset adjustment is applied to the rear flange using the following formula:

FLANGE_OFFSET=FLANGE_OFFSET−OFFSET_ADJUST.

26. The method of claim 25, further comprising:

relocating the turnaround position for a flange for the next turnaround using the following formula:

TURNAROUND_POSITION=SET TURNAROUND_POSITION+FLANGE_OFFSET.

27. A system for winding fiber onto a spool, the system comprising:

a spindle assembly for receiving the spool and rotating it around its longitudinal axis;

a fiber source for providing a continuous supply of fiber to the spool, the fiber source being positioned relative to the spindle assembly such that rotation of the spool by the spindle assembly causes fiber to be wound onto the spool around its longitudinal axis, a tension sensing device for sensing and providing feedback related to the amount of tension in the fiber, traverse means for causing the fiber to wind onto the spool back and forth between a front spool flange and a rear spool flange, the traverse means including a front turnaround position at the front spool flange and a rear turnaround position at the rear spool flange;

a controller for receiving the fiber tension feedback and using said feedback to determine what adjustment, if any, is to be made to the front and rear turnaround positions, wherein the controller is capable of calculating an error quantity by subtracting a setpoint tension from the amount of tension in the fiber sensed at each turnaround position.

* * * * *

UNITED STATES PATENT AND TRADEMARK OFFICE

CERTIFICATE OF CORRECTION

PATENT NO. : 6,443,386 B1 
DATED : September 3, 2002
INVENTOR(S) : Bednarczyk, David A et al.

It is certified that error appears in the above-identified patent and that said Letters Patent is hereby corrected as shown below:

Column 10,
Line 11, "an integral gain component $I_{_GAIN}$" should be -- an integral grain component I_GAIN --
Line 36, "TION+" should be -- TION+FLANGE_OFFSET --

Column 11,
Line 33, "OFFSET_ADJUST=[GAIN(AVERAGE_SAMPLE_ERROR-" should be -- OFFSET_ADJUST=[D_GAIN(AVERAGE_SAMPLE_ERROR- --

Signed and Sealed this

Twentieth Day of May, 2003

JAMES E. ROGAN
*Director of the United States Patent and Trademark Office*